US009627857B2

(12) United States Patent
Sumoyama et al.

(10) Patent No.: US 9,627,857 B2
(45) Date of Patent: Apr. 18, 2017

(54) SPARK PLUG

(71) Applicant: NGK SPARK PLUG CO., LTD., Nagoya-shi, Aichi (JP)

(72) Inventors: Daisuke Sumoyama, Nagoya (JP); Tomonori Kanemaru, Kasugai (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/118,954

(22) PCT Filed: Jan. 13, 2015

(86) PCT No.: PCT/JP2015/000100

§ 371 (c)(1),
(2) Date: Aug. 15, 2016

(87) PCT Pub. No.: WO2015/125406

PCT Pub. Date: Aug. 27, 2015

(65) Prior Publication Data

US 2017/0054274 A1 Feb. 23, 2017

(30) Foreign Application Priority Data

Feb. 24, 2014 (JP) ..... 2014-032403

(51) Int. Cl.
*H01T 13/20* (2006.01)
*H01T 13/39* (2006.01)
(Continued)

(52) U.S. Cl.
CPC ..... *H01T 13/39* (2013.01); *B22F 3/16* (2013.01); *C22C 5/04* (2013.01); *C22C 30/00* (2013.01);
(Continued)

(58) Field of Classification Search
CPC ..... H01T 13/39; H01T 13/32; H01T 21/02
(Continued)

(56) References Cited

U.S. PATENT DOCUMENTS 4,731,989 A * 3/1988 Furuya ..... F02C 3/30 431/7
5,998,913 A 12/1999 Matsutani
2006/0043855 A1 3/2006 Nunome et al.

FOREIGN PATENT DOCUMENTS

EP 0400950 A1 12/1990
GB 1564335 A 4/1980
(Continued)

OTHER PUBLICATIONS

Japan Patent Office, International Search Report issued in International Stage of current application (International Application No. PCT/JP2015/000100), mailed Feb. 10, 2015.
(Continued)

*Primary Examiner* — Vip Patel
(74) *Attorney, Agent, or Firm* — Stites & Harbison, PLLC; Jeffrey A. Haeberlin

(57) ABSTRACT

An object of the present invention is to provide a spark plug which includes, at at least one of a center electrode and a ground electrode, a tip having excellent spark wear resistance in a high temperature environment, thereby having excellent durability. A spark plug includes a center electrode and a ground electrode disposed with a gap provided between the center electrode and the ground electrode. At least one of the center electrode and the ground electrode includes a tip which defines the gap. The tip includes a metal base material containing Ir as a main component, and oxide particles containing at least one of oxides having a perovskite structure represented by general formula $ABO_3$ (A is at least one element selected from elements in group 2 in a periodic table, and B is at least one element selected from
(Continued)

metal elements). When a cross section of the tip is observed, an area proportion of the oxide particles is not lower than 1% and not higher than 13%.

10 Claims, 5 Drawing Sheets

(51) Int. Cl.

| | |
|---|---|
| ***H01T 13/32*** | (2006.01) |
| ***H01T 21/02*** | (2006.01) |
| ***B22F 3/16*** | (2006.01) |
| ***C22C 5/04*** | (2006.01) |
| ***C22C 32/00*** | (2006.01) |
| ***C22C 30/00*** | (2006.01) |

(52) U.S. Cl.
CPC ..... *C22C 32/0031* (2013.01); *H01T 13/32* (2013.01); *H01T 21/02* (2013.01); *B22F 2998/10* (2013.01)

(58) Field of Classification Search
USPC ..... 313/141, 144
See application file for complete search history.

(56) References Cited

FOREIGN PATENT DOCUMENTS

| | | | |
|---|---|---|---|
| JP | S52-118137 | A | 10/1977 |
| JP | H07-109783 | B2 | 11/1995 |
| JP | H11-016658 | A | 1/1999 |
| JP | 2004-107517 | A | 4/2004 |
| JP | 3672718 | B2 | 4/2005 |
| JP | 4402046 | B2 | 11/2009 |
| JP | 2010-153297 | A | 7/2010 |

OTHER PUBLICATIONS

Japan Patent Office, Notification of Reason for Rejection issued in corresponding Application No. 2014-032403, mailed Jan. 15, 2016.

* cited by examiner

SPARK PLUG

TECHNICAL FIELD

The present invention relates to a spark plug. In particular, the present invention relates to a spark plug in which at least one of a ground electrode and a center electrode is provided with a tip.

BACKGROUND ART

A spark plug is used for ignition of an internal combustion engine such as an automobile engine. The spark plug generally includes a tubular metallic shell, a tubular insulator disposed in an inner hole of the metallic shell, a center electrode disposed in a front side inner hole of the insulator, and a ground electrode joined at one end thereof to the front side of the metallic shell with a spark discharge gap provided between another end of the ground electrode and the center electrode. The spark plug causes spark discharge at the spark discharge gap formed between the front end of the center electrode and the front end of the ground electrode in a combustion chamber of an internal combustion engine, to burn fuel with which the combustion chamber is filled.

Meanwhile, a Ni alloy or the like is generally used as a material forming a ground electrode and a center electrode. A Ni alloy is slightly inferior in oxidation resistance and wear resistance to a precious metal alloy containing a precious metal such as Pt or Ir as a main component, but is suitably used as a material forming a ground electrode and a center electrode since Ni is cheaper than a precious metal. However, in recent years, the temperature in a combustion chamber tends to increase. When spark discharge is caused between the front end of a ground electrode and the front end of a center electrode which are formed of a Ni alloy or the like, the respective opposed front ends of the ground electrode and the center electrode are likely to cause spark wear. Thus, a method has been developed in which a tip is provided at each of the opposed front ends of the ground electrode and the center electrode such that spark discharge is caused at the tip, thereby improving the wear resistance of the ground electrode and the center electrode. As a material forming the tip, a material containing, as a main component, a precious metal that is excellent in oxidation resistance and spark wear resistance is often used.

For example, Patent Document 1 states that an object of "the present invention is to provide a higher-durability spark plug . . . , in which spark wear, oxidation wear, and abnormal wear of the precious metal member are suppressed, and a phenomenon of occurrence of spherical projections on the precious metal member is suppressed" (see lines 11 to 15, page 4 of Patent Document 1), and describes "a spark plug . . . , the precious metal member contains Ir as a main component, and contains not less than 0.3 mass % and not greater than 43 mass % of Rh, not less than 5.2 mass % and not greater than 41 mass % of Ru, and not less than 0.4 mass % and not greater than 19 mass % of Ni", as means for achieving the object (see claim 1 of Patent Document 1).

In addition, Patent Document 1 states that "In order to sustain superiority in another condition of use, for example, to further improve oxidation wear resistance at a high temperature (900° C. or higher), for example, Pt, Pd, Re, or Os can be contained in the precious metal member. Alternatively, in order to sustain superiority in another condition of use, for example, to further improve oxidation wear resistance and spark wear resistance in the case where the temperature of the plug (precious metal member) is relatively low (about 600° C.), an oxide (including a composite oxide) of an element selected from Sr, Y, La, Ce, Pr, Nd, Sm, Eu, Gd, Tb, Dy, Ho, Er, Tm, Yb, Lu, Ti, Zr, and Hf can be contained in the precious metal member. Particularly, $Y_2O_3$, $La_2O_3$, $ThO_2$, or $ZrO_2$ is preferably used" (see lines 39 to 47, page 4 of Patent Document 1).

PRIOR ART DOCUMENT

Patent Document

Patent Document 1: WO2004-107517

SUMMARY OF THE INVENTION

Problem to be Solved by the Invention

An object of the present invention is to provide a spark plug which includes, at at least one of a center electrode and a ground electrode, a tip having excellent spark wear resistance in a high temperature environment, thereby having excellent durability.

Means for Solving the Problem

Means for achieving the above object is (1) a spark plug including a center electrode and a ground electrode disposed with a gap provided between the center electrode and the ground electrode, wherein at least one of the center electrode and the ground electrode includes a tip which defines the gap, the tip includes a metal base material containing Ir as a main component, and oxide particles containing at least one of oxides having a perovskite structure represented by general formula $ABO_3$ (A is at least one element selected from elements in group 2 in a periodic table, and B is at least one element selected from metal elements), and when a cross section of the tip is observed, an area proportion of the oxide particles is not lower than 1% and not higher than 13%.

As preferable modes of the above (1), the following modes can be exemplified. (2) The metal base material contains Rh, and a ratio (M/N) of a number M of the oxide particles present on a crystal grain boundary of the metal base material relative to a total number N of the oxide particles contained in the tip is equal to or lower than 0.85. (3) In the spark plug of the above (1) or (2), crystal grains of the metal base material have an average grain size of 3 to 150 μm. (4) In the spark plug of any of the above (1) to (3), the oxide particles have an average particle size of 0.05 to 30 μm. (5) In the spark plug of any of the above (1) to (4), the metal base material contains not less than 1 mass % and not greater than 35 mass % of Rh. (6) In the spark plug of the above (5), the metal base material contains not less than 5 mass % and not greater than 20 mass % of Ru. (7) In the spark plug of any of the above (1) to (6), the metal base material contains not less than 0.4 mass % and not greater than 3 mass % of Ni. (8) In the spark plug of any of the above (1) to (7), the oxide is at least one of $SrZrO_3$, $SrHfO_3$, $BaZrO_3$, and $BaHfO_3$. (9) In the spark plug of any of the above (1) to (8), the tip has a cylindrical shape and has a diameter R of at most 1 mm. (10) In the spark plug of any of the above (1) to (9), in a cut surface of the tip that has been cut along a plane passing through an axis of the tip, a ratio (F/L) between a length F, of a fusion portion formed by fusion of the tip and the center electrode and/or the ground electrode, on a straight line indicating a joint surface between the tip and the center electrode and/or the ground electrode in a range from one side surface of the tip to another side surface of the tip and a length L of the tip in a direction perpendicular to the axis is equal to or higher than 0.6.

Advantageous Effects of the Invention

According to the present invention, since the tip includes a metal base material containing Ir as a main component, and oxide particles having a perovskite structure represented by general formula $ABO_3$, and the area proportion of the oxide particle relative to the entire area of an observation region when a cross section of the tip is observed is not lower than 1% and not higher than 13%, the tip of the present invention has excellent spark wear resistance in a high temperature environment, for example, in an environment of 800° C. or higher, and allows a spark plug having excellent durability to be provided.

When the metal base material contains Rh, the oxidation resistance of the metal base material in a high temperature environment improves. When the oxidation resistance of the metal base material improves, falling off of the oxide particles due to oxidation wear of the metal base material can be suppressed. Thus, when the metal base material contains Rh, an effect of improving spark wear resistance by the tip containing the oxide can be sufficiently exerted. However, even when Rh is contained, oxidation more easily occurs at the crystal grain boundary of the metal base material than in the crystal grains of the metal base material. Therefore, the oxide particles present on the crystal grain boundary of the metal base material at which oxidation easily occurs easily fall off as compared to those in the crystal grains of the metal base material. If the oxide particles fall off, the effect of improving the spark wear resistance by the oxide reduces. Therefore, when the ratio of the number of the oxide particles present on the crystal grain boundary of the metal base material relative to the total number of the oxide particles contained in the tip is equal to or lower than a specific value, a tip having even more excellent wear resistance can be made. As a result, a spark plug having even more excellent durability can be provided.

When the average grain size of the crystal grains of the metal base material is in the range of 3 to 150 μm, falling off of the metal base material can be suppressed, and thus a tip having even more excellent spark wear resistance can be made. As a result, a spark plug having even more excellent durability can be provided.

When the average grain size of the oxide particle is equal to or larger than 0.05 μm, scattering of the oxide particles present on the surface of the tip can be suppressed. In addition, when the average grain size of the oxide particle is equal to or smaller than 30 μm, loss of the oxide when the oxide particles fall off from the tip can be reduced. Thus, when the average grain size of the oxide particle is in the range of 0.05 to 30 μm, the oxide can sufficiently contribute to improvement of the spark wear resistance of the tip. As a result, a spark plug having even more excellent durability can be provided.

When the metal base material contains not less than 1 mass % of Rh, oxidation of the metal base material in the above-described high temperature environment can be further suppressed. In addition, when the metal base material contains not greater than 35 mass % of Rh, the melting point of the tip does not excessively decrease, and a tip having excellent spark wear resistance can be made. As a result, a spark plug having excellent durability can be provided.

When the metal base material contains not less than 1 mass % and not greater than 35 mass % of Rh and contains not less than 5 mass % of Ru, the oxidation resistance at the crystal grain boundary of the metal base material in the above-described high temperature environment further improves. When the oxidation resistance at the crystal grain boundary of the metal base material improves, falling off of the metal base material itself and falling off of the oxide particles present on the grain boundary can be suppressed. Thus, when the metal base material contains not less than 5 mass % of Ru, the effect of improving spark wear resistance by the tip containing the oxide can be sufficiently exerted. On the other hand, if the Ru content exceeds 20 mass %, the spark wear resistance conversely decreases. Therefore, when the metal base material contains not less than 5 mass % and not greater than 20 mass % of Ru, a tip having even more excellent spark wear resistance can be made. As a result, a spark plug having excellent durability can be provided.

When the metal base material contains not less than 0.4 mass % and not greater than 3 mass % of Ni, Ni can become liquefied and enter between another metal and oxide powder in sintering in a later-described tip manufacturing process. Thus, the sinterability improves, and a tip having even more excellent spark wear resistance can be made. As a result, a spark plug having excellent durability can be provided.

When the oxide is at least one of $SrZrO_3$, $SrHfO_3$, $BaZrO_3$, and $BaHfO_3$, a tip having even more excellent spark wear resistance can be made. As a result, a spark plug having excellent durability can be provided.

When a discharge surface of the tip is small, whereas the ignitability improves, the temperature of a discharge portion of the tip locally becomes high, and thus spark wear of the tip normally accelerates. On the other hand, in the case where the tip has a diameter R of at most 1 mm in the spark plug of the present invention having excellent spark wear resistance in a high temperature range, acceleration of spark wear can be suppressed while the ignitability is improved, as compared to a conventional tip.

When the volume of the fusion portion is increased and the ratio (F/L) is equal to or higher than 0.6, welding strength between the tip and the center electrode and/or the ground electrode can be improved. On the other hand, when the volume of the fusion portion is increased, spark wear of the tip normally accelerates. However, when the ratio (F/L) in the spark plug of the present invention having excellent spark wear resistance is equal to or higher than 0.6, the spark wear resistance can be maintained while the welding strength is improved.

MODES FOR CARRYING OUT THE INVENTION

A spark plug according to the present invention includes a center electrode and a ground electrode disposed with a gap provided between the center electrode and the ground electrode, and at least one of the center electrode and the ground electrode includes a tip which defines the gap.

Figure 1:
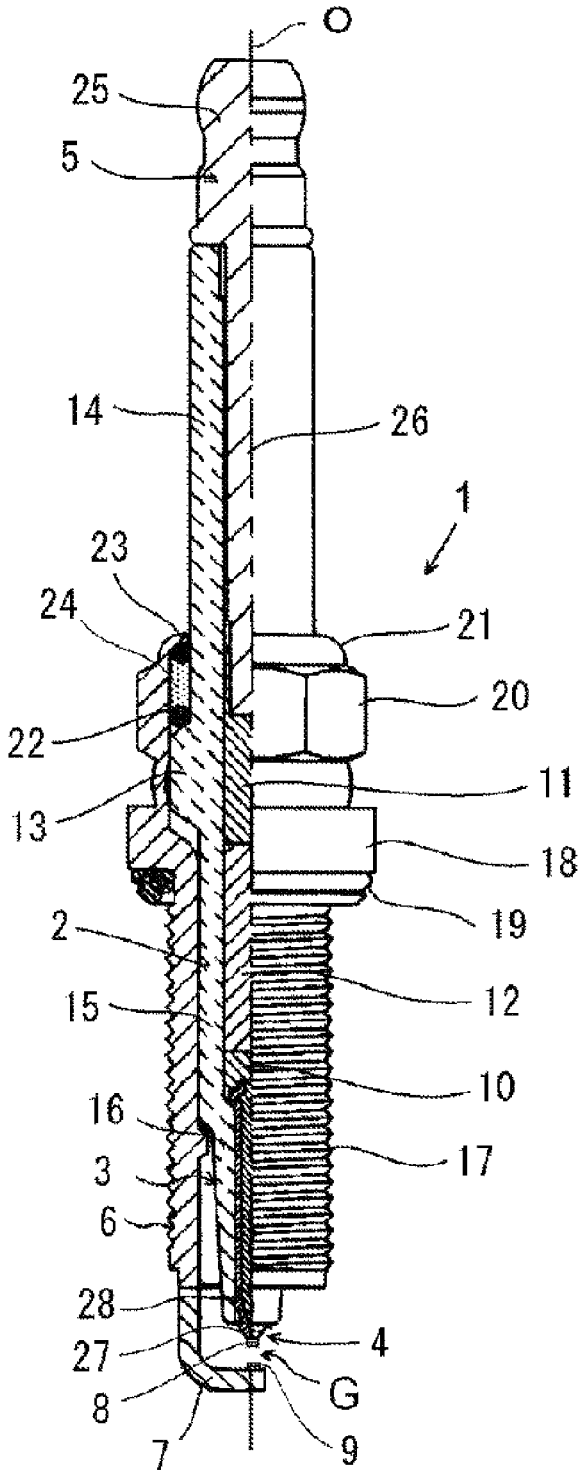
FIG. 1 Partially sectional explanatory view of a spark plug which is one embodiment of a spark plug according to the present invention.

A spark plug which is one embodiment of the spark plug according to the present invention is shown in FIG. 1. FIG. 1 is a partially sectional explanatory view of the spark plug 1 which is one embodiment of the spark plug according to the present invention. A description will be given with the downward direction on the sheet as a frontward direction along an axis O and the upward direction on the sheet as a rearward direction along the axis O in FIG. 1.

As shown in FIG. 1, the spark plug 1 includes: a substantially cylindrical insulator 3 which has an axial bore 2 extending in the direction of the axis O; a substantially rod-shaped center electrode 4 which is provided at the front side in the axial bore 2; a metal terminal 5 which is provided at the rear side in the axial bore 2; a substantially cylindrical metallic shell 6 which holds the insulator 3; a ground electrode 7 which is opposed at one end thereof to a front end face of the center electrode 4 across a spark discharge gap G and is joined at another end thereof to an end face of the metallic shell 6; and tips 8 and 9 which are provided at the center electrode 4 and the ground electrode 7, respectively.

To the insulator 3, the center electrode 4 is provided at the front side in the axial bore 2, the metal terminal 5 is provided at the rear side in the axial bore 2, and seal bodies 10 and 11 for fixing the center electrode 4 and the metal terminal 5 in the axial bore 2 and a resistor 12 for reducing propagation noise are provided between the center electrode 4 and the metal terminal 5. A flange portion 13 is formed near the center, in the direction of the axis O, of the insulator 3 so as to project in the radial direction, and a rear trunk portion 14 which accommodates the metal terminal 5 and insulates the metal terminal 5 and the metallic shell 6 from each other is formed at the rear side of the flange portion 13. A front trunk portion 15 which accommodates the resistor 12 is formed at the front side of the flange portion 13, and a leg portion 16 which accommodates the center electrode 4 and has an outer diameter smaller than that of the front trunk portion 15 is formed at the front side of the front trunk portion 15. The insulator 3 is fixed to the metallic shell 6 in a state where an end portion, in the frontward direction, of the insulator 3 projects from a front end face of the metallic shell 6. The insulator 3 is desirably formed from a material having mechanical strength, thermal strength, and electrical strength, and an example of such a material is a ceramic sintered body which contains alumina as a main material.

The metallic shell 6 has a substantially cylindrical shape and is formed such that the metallic shell 6 holds the insulator 3 when the insulator 3 is inserted therein. The metallic shell 6 has a screw portion 17 formed on an outer peripheral surface thereof in the frontward direction, and the screw portion 17 is used for mounting the spark plug 1 to a cylinder head of an internal combustion engine which is not shown. A flange-shaped gas seal portion 18 is formed at the rear side of the screw portion 17, and a gasket 19 is fitted between the gas seal portion 18 and the screw portion 17. A tool engagement portion 20 for engaging a tool such as a spanner or a wrench is formed at the rear side of the gas seal portion 18, and a crimping portion 21 is formed at the rear side of the tool engagement portion 20. Ring-shaped packings 22 and 23 and a talc 24 are disposed in annular spaces formed between inner peripheral surfaces of the crimping portion 21 and the tool engagement portion 20 and an outer peripheral surface of the insulator 3, so that the insulator 3 is fixed to the metallic shell 6. The metallic shell 6 can be formed from a conductive steel material such as low-carbon steel.

The metal terminal 5 is a terminal for applying a voltage for causing spark discharge between the center electrode 4 and the ground electrode 7, from the outside to the center electrode 4. The metal terminal 5 includes: an exposure portion 25 which has an outer diameter larger than the inner diameter of the axial bore 2, is exposed from the axial bore 2, and has a flange-shaped portion partially in contact with a rear side end face in the direction of the axis O; and a substantially cylindrical columnar portion 26 which extends in the frontward direction from the front side, in the direction of the axis O, of the exposure portion 25 and is accommodated in the axial bore 2. The metal terminal 5 can be formed from a metal material such as low-carbon steel.

The center electrode 4 has a substantially rod shape, and is composed of an outer layer 27 and a core portion 28 which is formed so as to be concentrically embedded in an axial portion within the outer layer 27. The center electrode 4 is fixed in the axial bore 2 of the insulator 3 in a state where a front end thereof projects from a front end face of the insulator 3, and is kept insulated from the metallic shell 6. The core portion 28 is formed from a material having a higher coefficient of thermal conductivity than that of the outer layer 27, and examples of such a material can include Cu, a Cu alloy, Ag, an Ag alloy, and pure Ni. The outer layer 27 can be formed from a known material used for the center electrode 4, such as a Ni alloy.

The ground electrode 7 is formed into, for example, a substantially prismatic body such that: one end thereof is joined to the front end face of the metallic shell 6; the ground electrode 7 is bent in a substantially L shape; and another end thereof is opposed to the front end of the center electrode 4 across the spark discharge gap G. The ground electrode 7 can be formed from a known material used for the ground electrode 7, such as a Ni alloy. The spark discharge gap G in the spark plug 1 of the embodiment indicates the shortest distance between the tip 8 provided at the front end of the center electrode 4 and the tip 9 provided at the front end of the ground electrode 7, and is normally set at 0.3 to 1.5 mm. At least one of the tips 8 and 9 may be provided at at least one of the corresponding opposed front ends of the ground electrode 7 and the center electrode 4. For example, in the case where the tip 9 is provided at the front end of the ground electrode 7 whose temperature easily rises and the tip 8 is not provided at the front end of the center electrode 4, the shortest distance between opposed surfaces of the center electrode 4 and the tip 9 provided at the ground electrode 7 corresponds to the spark discharge gap G.

Figure 2:
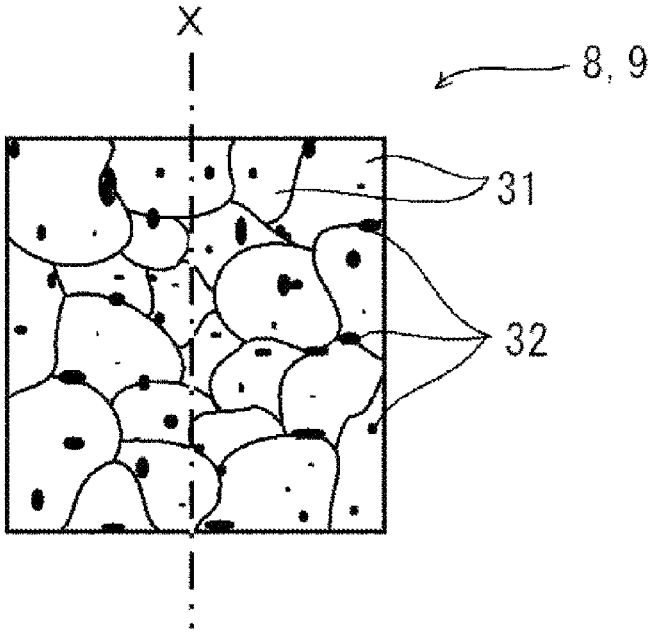
FIG. 2 Sectional explanatory view schematically showing a main portion of a cross section of a tip in the spark plug shown in FIG. 1.

FIG. 2 is a sectional explanatory view schematically showing a main portion of a cross section of each tip 8, 9 in the spark plug 1. Each tip 8, 9 contains a metal base material 31 containing Ir as a main component, and oxide particles 32 containing at least one of oxides having a perovskite structure represented by general formula $ABO_3$ (A is at least one element selected from the elements in group 2 in the periodic table, and B is at least one element selected from metal elements). When a cross section of each tip 8, 9 is observed, the area proportion of the oxide particles 32 is not lower than 1% and not higher than 13%. Such tips 8 and 9 have excellent spark wear resistance in a high temperature environment, for example, in an environment of 800° C. or higher, and allow a spark plug 1 having excellent durability to be provided.

The reason why the spark wear resistance of each tip 8, 9 improves when each tip 8, 9 contains the oxide particles 32 in the above proportion is thought to be that: oxide easily causes electric discharge due to its lower work function than that of metal and thus a discharge voltage decreases; and oxide remains also on the surface of a fusion portion formed by fusion of the tips 8 and 9, and the center electrode 4 and the ground electrode 7, thus sparking easily occurs at the fusion portion, and the number of times of sparking at the tip decreases. If the area proportion of the oxide particles 32 relative to the entire area of an observation region when the cross section of each tip 8, 9 is observed is lower than 1%, the effect of improving spark wear resistance by each tip 8, 9 containing the oxide particles 32 cannot be obtained. In addition, if the area proportion exceeds 13%, in a later-described tip manufacturing process, the sintered densities of the tips 8 and 9 decrease, the tips 8 and 9 easily become porous, and tip breakage such as crack may occur in the tips 8 and 9. Thus, conversely, the spark wear resistance decreases.

The area proportion of the oxide particles relative to the entire area of the observation region on the cross section of each tip 8, 9 can be measured, for example, as follows. First, each cylindrical tip 8, 9 is cut along a plane passing through a central axis X thereof and polished, and the resultant cross section is observed with a SEM to measure the area of each oxide particle found in the observation region. The sum of the measured areas of all the oxide particles is obtained, and the proportion of the sum of the measured areas of all the oxide particles relative to the entire area of the observation region is calculated.

The metal base material is composed of a metal element material containing Ir as a main component, may contain only Ir, or may contain a metal element other than Ir. Examples of the contained metal element other than Ir can include Rh, Ru, Ni, Pd, Pt, Re, W, Mo, Al, Co, and Fe. As the contained metal element other than Ir, only one of the above metal elements may be contained, or any combination of two or more of the above metal elements may be contained. Containing Ir as a main component means that among the metal elements contained in the metal base material, the metal element having the highest mass proportion is Ir.

The metal base material preferably contains Rh as a metal element other than Ir, and Rh is particularly preferably contained in a proportion of not less than 1 mass % and not greater than 35 mass % with respect to the entire metal base material. If the metal base material contains Rh, particularly not less than 1 mass % of Rh, when the tip is exposed to a high temperature environment, oxidation of the metal base material is suppressed. When oxidation of the metal base material is suppressed, falling off of the oxide particles due to oxidation wear of the metal base material can be suppressed. Thus, when the metal base material contains Rh, the effect of improving spark wear resistance by the tip containing the oxide can be sufficiently exerted. As the Rh content increases, the melting point of each tip 8, 9 decreases. Therefore, if the metal base material contains not greater than 35 mass % of Rh, the melting point of each tip 8, 9 does not excessively decrease, and a tip having excellent spark wear resistance can be made. As a result, a spark plug having excellent durability can be provided.

When the metal base material contains Ir as a main component and also contains not less than 1 mass % and not greater than 35 mass % of Rh with respect to the entire metal base material, the metal base material preferably contains not less than 5 mass % and not greater than 20 mass % of Ru. If the metal base material contains not less than 5 mass % of Ru when the metal base material contains Rh in the above range, oxidation at the crystal grain boundary of the metal base material in a high temperature environment can be further suppressed. When oxidation at the crystal grain boundary of the metal base material can be suppressed, falling off of the metal base material itself and falling off of the oxide particles present on the crystal grain boundary can be suppressed. Thus, when the metal base material contains not less than 5 mass % of Ru, the effect of improving spark wear resistance by the tip containing the oxide can be sufficiently exerted. If the Ru content exceeds 20 mass %, conversely, spark wear easily occurs. Therefore, if the metal base material contains not greater than 20 mass % of Ru when the metal base material contains Rh in the above range, a tip having even more excellent spark wear resistance can be made. As a result, a spark plug having excellent durability can be provided.

The metal base material preferably contains not less than 0.4 mass % and not greater than 3 mass % of Ni. If the metal base material contains not less than 0.4 mass % and not greater than 3 mass % of Ni, while a decrease in the melting point of the metal base material is suppressed, Ni can become liquefied and enter between another metal and oxide powder in sintering in the later-described tip manufacturing process. Thus, the sinterability improves, and a tip having even more excellent spark wear resistance can be made. As a result, a spark plug having excellent durability can be provided.

The composition of the metal base material 31 in each tip 8, 9 can be measured as follows. First, each tip 8, 9 is cut to expose the resultant cross section thereof, a plurality of locations (e.g., five locations) on the metal base material 31 are arbitrarily selected in the cross section of each tip 8, 9, and FE-EPMA (Field Emission Electron Probe Micro Analysis): WDS (Wavelength Dispersive X-ray Spectrometer) analysis using JXA-8500F manufactured by JEOL Ltd. is performed to measure a mass composition at each location. Next, the average of the measured values at the plurality of locations is calculated and regarded as the composition of the metal base material 31. The measured locations exclude a fusion portion 33 formed by fusion of the tips 8 and 9 and the electrodes 4 and 7.

The crystal grains of the metal base material preferably have an average grain size of 3 to 150 μm. If the average grain size of the crystal grains of the metal base material is not smaller than 3 μm, falling off of the crystal grains of the metal base material can be suppressed. Thus, the effect of improving spark wear resistance by containing the oxide is easily exerted, and a tip having more excellent spark wear resistance can be made. In addition, as the grain size of the crystal grains of the metal base material increases, the crystal grain boundary of the metal base material becomes linear, and oxidation easily proceeds to the inside of the tip. Thus, even when the crystal grains of the metal base material are excessively large, the crystal grains easily fall off. Therefore, when the average grain size of the crystal grains of the metal base material is not larger than 150 μm, the crystal grains are less likely to fall off, and the effect of improving spark wear resistance by the oxide contained in the metal base material is exerted. As a result, a spark plug having even more excellent durability can be provided.

The average grain size of the crystal grains of the metal base material can be measured, for example, as follows. First, each cylindrical tip 8, 9 is cut along a plane passing through the central axis X and polished, and the resultant cross section subjected to cross section polisher processing: SM-09010 manufactured by JEOL Ltd. or ion milling processing: IM-4000 manufactured by Hitachi High-Technologies Corporation is observed in a composition image with an FE-SEM (Field Emission Scanning Electron Microscope): JSM-6330F manufactured by JEOL Ltd. The areas of all the crystal grains of the metal base material found in an observation region are measured, a diameter calculated from a circle having the same area as that of each of the crystal grains of the metal base material is regarded as the crystal grain diameter of each crystal grain, and the arithmetic average of all the measured values is calculated, whereby the average grain size of the crystal grains of the metal base material can be obtained.

Figure 3:
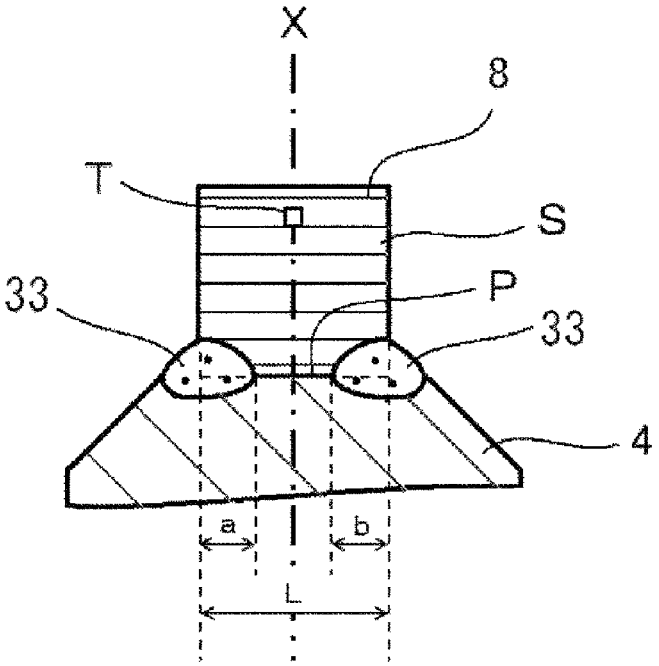
FIG. 3 Sectional explanatory view showing, in an enlarged manner, a main portion of a center electrode provided with the tip in the spark plug shown in FIG. 1.

As the observation region T, a region which is near the radial center of the tip and has an edge side, for example, at a position away by 50 μm from a surface to be subjected to electric discharge, not at an end of the cross section, may be selected as shown in FIG. 3. If the number of the oxide particles in the observation region T is less than 20, the observation region T may be widened, and observation may be performed to measure the average grain size of the crystal grains of the metal base material.

The average grain size of the crystal grains of the metal base material can be adjusted by appropriately changing the particle size of the oxide, a pressure in producing a green compact of a mixture of oxide powder and metal powder, a sintering time and a sintering temperature, a pressure in sizing after the sintering, and a temperature of heat treatment after the sizing, and the like in the later-described tip manufacturing process.

The oxide is an oxide having a perovskite structure represented by general formula $ABO_3$, the element at the A site in the above general formula is at least one element selected from the elements in group 2 in the periodic table according to IUPAC Nomenclature of Inorganic Chemistry, Recommendations 1990, and examples thereof can include Mg, Ca, Sr, and Ba. The element at the B site in the above general formula is at least one element selected from metal elements, and examples of the metal elements can include Al, Sc, Ti, V, Cr, Mn, Fe, Co, Ni, Cu, Zn, Ga, Y, Zr, Nb, Mo, Ru, Hf, Ta, W, Pb, and Bi. Each of the elements at the A site and the B site is not limited to one element, and, for example, may include two or more of the above-described elements. Examples of such an oxide can include $SrZrO_3$, $SrHfO_3$, $SrTiO_3$, $BaZrO_3$, $BaHfO_3$, $CaZrO_3$, $CaHfO_3$, $CaTiO_3$, $MgTiO_3$, and $BaTiO_3$. As the oxide, among these oxides, $SrZrO_3$, $SrHfO_3$, $SrTiO_3$, and $BaZrO_3$ are preferable. The oxide particles, for example, may contain only one of the above-described oxides having a perovskite structure, or may contain any two or more of the oxides.

With an XRD (X-Ray-Diffractometer), it can be identified that the oxide particles contain an oxide having a perovskite structure.

Preferably, the metal base material contains Rh, and the ratio (M/N) of the number M of the oxide particles present on the crystal grain boundary of the metal base material relative to the total number N of the oxide particles contained in the tip is equal to or lower than 0.85.

When the metal base material contains Rh, the oxidation resistance of the metal base material improves, and thus falling off of the oxide particles due to oxidation wear of the metal base material can be suppressed. Therefore, when the metal base material contains Rh, the effect of improving spark wear resistance by the tip containing the oxide is easily exerted. However, even when Rh is contained, oxidation more easily proceeds at the crystal grain boundary of the metal base material than in the crystal grains of the metal base material. Therefore, the oxide particles present on the crystal grain boundary of the metal base material at which oxidation easily occurs relatively easily fall off as compared to those in the crystal grains of the metal base material. If the oxide particles fall off, the effect of improving spark wear resistance by containing the oxide reduces. Therefore, when the ratio (M/N) is equal to or lower than 0.85, a tip having even more excellent wear resistance can be made. As a result, a spark plug having even more excellent durability can be provided.

The oxide particles preferably have an average particle size of 0.05 to 30 μm. When the average particle size of the oxide particles is in the range of 0.05 to 30 μm, a tip having even more excellent spark wear resistance can be made. When the average particle size of the oxide particles is equal to or larger than 0.05 μm, scattering of the oxide particles present on the surface of the tip can be suppressed. When the average particle size of the oxide particles is equal to or smaller than 30 μm, loss of the oxide when the oxide particles fall off from the tip can be reduced. Thus, the oxide can sufficiently contribute to improvement of the spark wear resistance of the tip. As a result, a spark plug having even more excellent durability can be provided.

The ratio (M/N) and the average particle size of the oxide particles can be measured, for example, as follows. First, each cylindrical tip 8, 9 is cut along a plane passing through the central axis X and polished, and the resultant cross section is observed with an FE-SEM. The number n of all the oxide particles found in an observation region and the number m of the oxide particles present on the crystal grain boundary of the metal base material, are counted. A ratio (m/n) is calculated from these numbers n and m. The ratio (m/n) in the observation region is estimated to be substantially equal to a ratio (M/N) in the total volume of the tip, and the ratio (m/n) can be regarded as the ratio (M/N). In addition, the average particle size of the oxide particles can be measured as follows. First, the areas of all the oxide particles found in the observation region are measured, a diameter calculated from a circle having the same area as that of each of the oxide particles is regarded as the particle size of the oxide particle, and the arithmetic average of all the measured values is calculated, whereby the average particle size of the oxide particles can be obtained. The observation region for the ratio (M/N) and the average particle size of the oxide particles can be a region similar to the above-described observation region in which the crystal grains of the metal base material are observed. If it is difficult to view the oxide particles since the oxide particles are excessively small, observation may be performed at increased magnification.

The ratio (M/N) and the average particle size of the oxide particles can be adjusted by appropriately changing the powder particle size of the oxide, a pressure in producing a green compact of a mixture of oxide powder and metal powder, a sintering time, a sintering temperature, a pressure in sizing after the sintering, and a temperature of heat treatment after the sizing, and the like in the later-described tip manufacturing process.

The shapes and the sizes of the tips 8 and 9 are not particularly limited. However, if discharge portions of the tips 8 and 9 are small, the spark wear resistance effect can be even further exerted. Whereas the ignitability improves if discharge surfaces of the tips 8 and 9 are small, the temperatures of the discharge portions locally become high even when the atmospheric temperature is not so high if the discharge surfaces of the tips 8 and 9 are small, and thus spark wear of the tips 8 and 9 accelerates. On the other hand, in the case where the tips 8 and 9 having excellent spark wear resistance have a cylindrical shape, have a diameter R of at most 1 mm, and are shaped such that the temperatures of the discharge portions locally become high, acceleration of spark wear can be suppressed while the ignitability is improved. In the case where the tips 8 and 9 have a cylindrical shape and have a diameter R of at most 1 mm, it is more preferable if the metal base material in each tip 8, 9 contains Rh, since a decrease in the oxidation resistance can be suppressed when the temperatures of the discharge portions become high.

FIG. 3 is a sectional explanatory view showing, in an enlarged manner, a main portion of the center electrode provided with the tip. As shown in FIG. 3, the tip 8 has a cylindrical shape, and in a cut surface S of the tip 8 that has been cut along a plane passing through the axis X of the tip 8, when a straight line indicating a joint surface between the tip 8 and the center electrode 4 is designated by P, and when the length of the fusion portion 33 on the straight line P in a range from one side surface of the tip 8 to another side surface of the tip 8 is denoted by F (=a+b) and the length of the tip 8 in a direction perpendicular to the axis X is denoted by L, if the ratio (F/L) between the length F of the fusion portion 33 and the length L of the tip 8 is equal to or higher than 0.6, the spark wear resistance effect can be even further exerted. When the volume of the fusion portion 33 is increased, welding strength of the tip 8 to the center electrode 4 can be normally improved. On the other hand, as the volume of the fusion portion 33 increases, the coefficient of thermal conductivity decreases and spark wear of the tip 8 accelerates. Therefore, when the tip 8 is exposed to a high temperature environment, spark wear even further accelerates, and thus it becomes difficult to maintain both the spark wear resistance and the welding strength. However, the tip 8 having excellent spark wear resistance in a high temperature environment is able to suppress acceleration of spark wear when the volume of the fusion portion 33 is larger than normal. Thus, while the peeling resistance of the tip 8 from the center electrode 4 is improved, the spark wear resistance can be improved. Although the tip 8 provided at the center electrode 4 has been described with reference to FIG. 3, the same applies to the ground electrode 7. In addition, in the case where the ratio (F/L) in each tip 8, 9 is equal to or higher than 0.6, it is more preferable if the metal base material in each tip 8, 9 contains Rh, since a decrease in the oxidation resistance can be suppressed when the temperatures of the discharge portions become high.

In the embodiment shown in FIG. 3, the fusion portion 33 is formed at both sides of the axis X of the tip 8 which is a center, and the fusion portion 33 is not formed at a center portion of the tip 8. Thus, the length F in the embodiment is the sum of the lengths, on the straight line P, of the two fusion portions 33 formed by fusion of the tip 8 and the center electrode 4, that is, the sum of the length a and the length b. If the entirety of the surface of the tip that is joined to the electrode is joined via the fusion portion, the length F and the length L are equal to each other, and the ratio (F/L) is 1.

The length F and the length L can be obtained by: capturing an image of a cut surface of the tip that has been cut along a plane passing through the axis X, with, for example, a CT scan or an FE-SEM; and measuring the length F of the fusion portion and the length L of the tip in the direction perpendicular to the axis X in the obtained image. In the case where the tip has a cylindrical shape as in the embodiment, the length L is equal to the diameter of the tip, and may be measured at any location in the direction of the axis X. However, for example, in the case where the tip has a trapezoidal shape, the length L of the tip is measured at a portion where the tip and the center electrode are in contact with each other.

The spark plug 1 is manufactured, for example, as follows. A method of manufacturing the tips 8 and 9 will be described below. As the tips 8 and 9, for example, cylindrical tips 8 and 9 can be produced by: mixing powder of the oxide having a perovskite structure and metal powder in a predetermined blending ratio; forming a green compact from the mixture through metallic mold pressing, CIP molding, extrusion molding, injection molding, or the like; degreasing the green compact; and sintering the green compact in vacuum or in a non-oxidizing or reducing atmosphere. For the tips 8 and 9, for example, plastic processing by sizing may be performed on the sintered body to improve the sintered density.

The center electrode 4 and/or the ground electrode 7 can be produced, for example, by: preparing a molten metal of an alloy having a desired composition by using a vacuum melting furnace; performing drawing processing or the like; and performing adjustment to a predetermined shape and a predetermined dimension as appropriate. As the center electrode 4, a center electrode 4 having a core portion within an outer layer is formed by: inserting, into an outer member formed in a cup shape and made from a Ni alloy or the like, an inner member made from a Cu alloy or the like having a higher coefficient of thermal conductivity than that of the outer member; and performing plastic processing such as extruding. The ground electrode 7 of the spark plug 1 of the embodiment is formed from one material, but similarly to the center electrode 4, the ground electrode 7 may be composed of an outer layer and a core portion provided so as to be embedded into an axial portion of the outer layer. In this case, similarly to the center electrode 4, an inner member can be inserted into an outer member formed in a cup shape, plastic processing such as extruding can be performed, and then plastic processing into a substantially prismatic shape can be performed to obtain the ground electrode 7.

Next, one end of the ground electrode 7 is joined by means of electric resistance welding and/or laser welding or the like to an end face of the metallic shell 6 which is formed into a predetermined shape by plastic processing or the like. Next, Zn plating or Ni plating is applied to the metallic shell 6 to which the ground electrode 7 has been joined. After the application of the Zn plating or the Ni plating, trivalent chromate treatment may be performed. In addition, the plating applied to the ground electrode may be peeled off.

Next, the tips 8 and 9 produced as described above are melted and fixed to the ground electrode 7 and the center electrode 4 by means of resistance welding and/or laser welding or the like. In the case where the tips 8 and 9 are joined to the ground electrode 7 and/or the center electrode 4 by means of resistance welding, for example, resistance welding is performed while the tips 8 and 9 are placed and pressed at predetermined positions on the ground electrode 7 and/or the center electrode 4. In the case where the tips 8 and 9 are joined to the ground electrode 7 and/or the center electrode 4 by means of laser welding, for example, the tips 8 and 9 are placed at predetermined positions on the ground electrode 7 and/or the center electrode 4, a laser beam is applied partially or over the entire circumference to contact portions between the tips 8 and 9 and the ground electrode 7 and/or the center electrode 4 from obliquely above the tips 8 and 9 or parallel to a contact surface between the tips 8 and 9 and the ground electrode 7 and/or the center electrode 4. After resistance welding, laser welding may be performed.

Meanwhile, the insulator 3 is produced by baking a ceramic material or the like into a predetermined shape, the center electrode 4 to which the tip 8 has been joined is inserted into the axial bore 2 of the insulator 3, and the axial bore 2 is filled with glass powder forming the seal bodies 10 and 11, a resistor composition forming the resistor 12, and the glass powder in this order under preliminary compression. Next, the resistor composition and the glass powder are compressed and heated while the metal terminal 5 is pressed in through an end portion in the axial bore 2. Thus, the resistor composition and the glass powder are sintered to form the resistor 12 and the seal bodies 10 and 11. Next, the insulator 3 to which the center electrode 4 and the like have been fixed is assembled to the metallic shell 6 to which the ground electrode 7 has been joined. At the end, a front end portion of the ground electrode 7 is bent to the center electrode 4 side such that one end of the ground electrode 7 is opposed to the front end portion of the center electrode 4, so that the spark plug 1 is manufactured.

The spark plug 1 according to the present invention is used as an ignition plug for an internal combustion engine for an automobile, such as a gasoline engine. The spark plug 1 is fixed at a predetermined position by the screw portion 17 being screwed into a screw hole provided in a head (not shown) which defines a combustion chamber of the internal combustion engine. The spark plug 1 according to the present invention can be used for any internal combustion engine, but is suitably used for an internal combustion engine in which the tips 8 and 9 are exposed to a high temperature environment, or an internal combustion engine in which discharge energy is high and the temperatures of the tips 8 and 9 are likely to become high.

The spark plug 1 according to the present invention is not limited to the above-described embodiment, and various changes can be made as long as the purpose of the present invention of the present application can be accomplished. For example, although, in the spark plug 1, the front end face of the center electrode 4 and the outer peripheral surface of the front end portion of the ground electrode 7 are opposed to each other across the spark discharge gap G in the direction of the axis O, the side surface of the center electrode and the front end face of the ground electrode may be opposed to each other across a spark discharge gap in the radius direction of the center electrode in the present invention. In this case, one or a plurality of ground electrodes opposed to the side surface of the center electrode may be provided.

EXAMPLES

[Test Nos. 1 to 27]<Production of Spark Plug Test Body>

A tip was manufactured as follows. First, metal powder was blended in the same blending ratio as the composition of the metal base material shown in Tables 1 and 2, and was mixed with oxide powder in a predetermined ratio, and the mixture was molded to obtain a green compact. The green compact was degreased, and then was sintered in vacuum or in a non-oxidizing or reducing atmosphere, to produce a cylindrical tip having a relative density of not lower than 95%.

A center electrode and a ground electrode were produced by preparing a molten metal of an alloy having a predetermined composition, performing drawing processing or the like, and performing adjustment to a predetermined shape and a predetermined dimension as appropriate as described above, as a center electrode composed of an outer layer made of a Ni alloy and a core portion made of a Cu alloy and a ground electrode made from a Ni alloy.

Next, the ground electrode was joined to one end face of a metallic shell, and the produced tip was joined by means of laser welding to the end of the ground electrode to which the metallic shell was not joined. Meanwhile, the produced tip was joined to the front end of the center electrode by means of laser welding.

An insulator was produced by baking a ceramic material into a predetermined shape, the center electrode to which the tip was joined was inserted into the axial bore of the insulator, and the axial bore was filled with glass powder, a resistor composition, and the glass powder in this order. At the end, a metal terminal was inserted and fixed therein.

Next, the insulator to which the center electrode was fixed was assembled to the metallic shell to which the ground electrode was joined. At the end, the front end portion of the ground electrode was bent to the center electrode side such that the tip joined to the ground electrode and the tip joined to the front end face of the center electrode were opposed to each other, so that a spark plug test body was manufactured.

The screw diameter of the manufactured spark plug test body was M12, the spark discharge gap G indicating the shortest distance between the tips was 1.1 mm, and the diameter of each tip was 1 mm.

The tip welded to the center electrode was cut along a plane passing through a central axis thereof, the resultant cut surface was polished with a cross section polisher (SM-09010, manufactured by JEOL Ltd.), and the following analysis was performed on the resultant polished surface.

The composition of the metal base material contained in the tip, which is shown in Tables 1 and 2, was measured by performing WDS analysis of FE-EPMA (JXA-8500F, manufactured by JEOL Ltd.) on the above-described polished surface of the tip, avoiding oxide. As measured locations, five locations on the metal base material of the tip were arbitrarily selected for the measurement, and the average of measured values at the five locations was calculated and regarded as a composition of the metal base material.

Identification of the oxide particles contained in the tip, which is shown in Tables 1 and 2, was determined by using XRD on the above-described polished surface of the tip. As a result of the determination, the oxide particles contained in the tip were oxides having a perovskite structure as shown in Tables 1 and 2.

The above-described polished surface of the tip was observed by using an FE-SEM, and a composition image was captured as a photographed image. An observation region was set as a range of 50 μm×50 μm which was near the radial center of the tip and had an edge side at a position away by 50 μm from a surface to be subjected to electric discharge. If it was difficult to view the oxide particles since the oxide particles were excessively small, an image was captured at increased magnification. In addition, when the number of the crystal grains of the metal base material in the observation region was less than 20, the observation region was doubled (100 μm×100 μm). When the number of the crystal grains of the metal base material in the observation region was still less than 20, the observation region was enlarged up to 200 μm×200 μm. When it was difficult to identify whether a target was an oxide or a void, the target was identified by mapping analysis of WDS.

For the area proportion of all the oxide particles in the observation region, the areas of all the oxide particles were measured with an image editor (Photoshop: manufactured by Adobe Systems Incorporated), and the area proportion of all the oxide particles relative to the entire area of the observation region was calculated.

For the average particle size of the oxide particles, the areas of all the oxide particles observed in the observation region were obtained, a diameter calculated from a circle having the same area as that of each of the oxide particles was regarded as the particle diameter of the oxide particle, and the arithmetic average of all the measured values was calculated, whereby the average particle size of the oxide particles was calculated. The average particle size of the oxide particles in the tip which is shown in Tables 1 and 2 was in the range of 0.05 to 30 μm.

For the average grain size of the crystal grains of the metal base material, the areas of all the crystal grains of the metal base material observed in the observation region were obtained, a diameter calculated from a circle having the same area as that of each of the crystal grains of the metal base material was regarded as the crystal grain diameter of the metal base material, and the arithmetic average of all the measured values was calculated, whereby the average grain size of the crystal grains of the metal base material was calculated. The average grain size of the crystal grains of the metal base material in the tip which is shown in Tables 1 and 2 was in the range of 3 to 150 μm.

For the ratio (M/N) of the number M of the oxide particles present on the crystal grain boundary of the metal base material relative to the total number N of the oxide particles contained in the tip, the total number n of the oxide particles in the observation region and the number m of the oxide particles present on the crystal grain boundary of the metal base material were counted, and a ratio (m/n) was calculated and regarded as the ratio (M/N). The ratio (M/N) in each tip which is shown in Tables 1 and 2 was equal to or lower than 0.85.

The above-described cut surface of the tip was observed in a composition image captured with an FE-SEM, and the length F and the length L shown in FIG. 3 were measured in the observed image. A value of the ratio (F/L) was calculated from these measured values. The ratio (F/L) in each tip which is shown in Tables 1 and 2 was equal to or higher than 0.6.

<Actual Machine Durability Test>

The manufactured spark plug test body was mounted to a test engine (a supercharged engine, an initial discharge voltage of 20 kV or higher, a displacement of 660 cc, three cylinders), and a durability test was conducted in which operation was performed for 200 hours at full throttle with a state of an engine speed of 6000 rpm being maintained. The temperatures of the center electrode and the ground electrode base material at locations away by 0.5 mm from the front ends thereof were measured, and were 950° C. and 1050° C., respectively.

<Evaluation of Spark Wear Resistance>

After the actual engine durability test, the volume of the tip joined to the center electrode was measured with a CT scan (TOSCANER-32250μhd manufactured by Toshiba Corporation). The wear volume proportion of each tip in the case where the wear volume of a tip that did not contain oxide was defined as 1, "(wear volume of each tip/wear volume of tip not containing oxide)×100(%)", was calculated. The calculated value was regarded as the wear volume proportion and evaluated according to the following criteria. The results are shown in Table 1, FIG. 4, and Table 2.

A: when the wear volume proportion was equal to or lower than 55%.

B: when the wear volume proportion exceeded 55% and was equal to or lower than 60%.

C: when the wear volume proportion exceeded 60% and was equal to or lower than 65%.

D: when the wear volume proportion exceeded 65% and was equal to or lower than 70%.

E: when the wear volume proportion exceeded 70%.

TABLE 1

| | | Composition of metal base material (mass %) | | | | Oxide particle | | Test results | |
|---|---|---|---|---|---|---|---|---|---|
| | No. | Ir | Rh | Ru | Ni | $ABO_3$ | Area proportion (%) | Wear volume proportion (%) | Evaluation |
| Comp. Ex. | 1 | 68 | 20 | 11 | 1 | $SrZrO_3$ | 0 | 100 | E |
| Comp. Ex. | 2 | 68 | 20 | 11 | 1 | | 0.5 | 85 | E |
| Ex. | 3 | 68 | 20 | 11 | 1 | | 1 | 55 | A |
| Ex. | 4 | 68 | 20 | 11 | 1 | | 5 | 53 | A |
| Ex. | 5 | 68 | 20 | 11 | 1 | | 8 | 54 | A |
| Ex. | 6 | 68 | 20 | 11 | 1 | | 13 | 55 | A |
| Comp. Ex. | 7 | 68 | 20 | 11 | 1 | | 15 | 84 | E |
| Ex. | 8 | 68 | 20 | 11 | 1 | $SrHfO_3$ | 5 | 54 | A |
| Ex. | 9 | 68 | 20 | 11 | 1 | $BaZrO_3$ | 5 | 53 | A |
| Ex. | 10 | 68 | 20 | 11 | 1 | $BaHfO_3$ | 5 | 53 | A |
| Comp. Ex. | 11 | 68 | 20 | 11 | 1 | $Y_2O_3$ | 5 | 95 | E |

TABLE 1-continued

| | | Composition of metal base material (mass %) | | | | Oxide particle | | Test results | |
|---|---|---|---|---|---|---|---|---|---|
| | No. | Ir | Rh | Ru | Ni | $ABO_3$ | Area proportion (%) | Wear volume proportion (%) | Evaluation |
| Comp. Ex. | 12 | 80 | 20 | | | $SrZrO_3$ | 0 | 100 | E |
| Ex. | 13 | 80 | 20 | | | | 1 | 63 | C |
| Ex. | 14 | 80 | 20 | | | | 5 | 61 | C |
| Ex. | 15 | 80 | 20 | | | | 13 | 63 | C |
| Comp. Ex. | 16 | 80 | 20 | | | | 15 | 88 | E |
| Comp. Ex. | 17 | 100 | | | | $SrZrO_3$ | 0 | 100 | E |
| Ex. | 18 | 100 | | | | | 1 | 68 | D |
| Ex. | 19 | 100 | | | | | 5 | 66 | D |
| Ex. | 20 | 100 | | | | | 13 | 69 | D |
| Comp. Ex. | 21 | 100 | | | | | 15 | 90 | E |

TABLE 2

| | | Composition of metal base material (mass %) | | | | Oxide particle | | Test results | |
|---|---|---|---|---|---|---|---|---|---|
| | No. | Ir | Rh | Ru | Ni | $ABO_3$ | Area proportion (%) | Wear volume proportion (%) | Evaluation |
| Ex. | 19 | 100 | | | | $SrZrO_3$ | 5 | 66 | D |
| | 22 | 99 | 1 | | | | | 63 | C |
| | 14 | 80 | 20 | | | | | 61 | C |
| | 23 | 65 | 35 | | | | | 62 | C |
| | 24 | 60 | 40 | | | | | 67 | D |
| | 25 | 95 | 1 | 4 | | | | 63 | C |
| | 26 | 94 | 1 | 5 | | | | 59 | C |
| | 27 | 88 | 1 | 11 | | | | 59 | B |
| | 28 | 79 | 1 | 20 | | | | 59 | B |
| | 29 | 78 | 1 | 21 | | | | 61 | B |
| | 30 | 81 | 8 | 11 | | | | 58 | C |
| | 31 | 75 | 15 | 11 | | | | 57 | B |
| | 32 | 69 | 20 | 11 | | | | 57 | B |
| | 33 | 61 | 35 | 4 | | | | 61 | C |
| | 34 | 60 | 35 | 5 | | | | 58 | B |
| | 35 | 54 | 35 | 11 | | | | 56 | B |
| | 36 | 45 | 35 | 20 | | | | 58 | B |
| | 37 | 68.7 | 20 | 11 | 0.3 | | | 56 | B |
| | 38 | 68.6 | 20 | 11 | 0.4 | | | 55 | A |
| | 4 | 68 | 20 | 11 | 1.0 | | | 53 | A |
| | 39 | 66 | 20 | 11 | 3.0 | | | 55 | A |
| | 40 | 75.5 | 20 | 1 | 3.5 | | | 57 | B |

Figure 4:
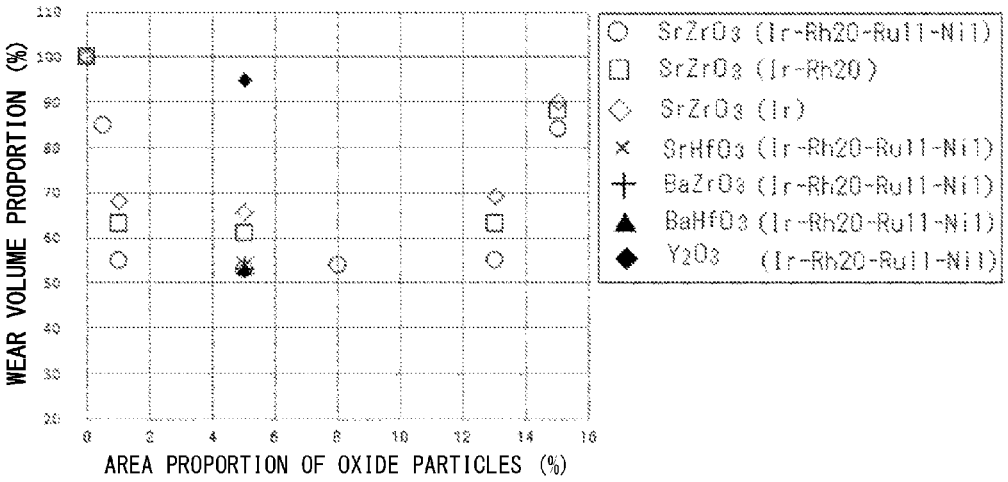
FIG. 4 Graph showing a relationship between an area proportion of oxide particles and a wear volume proportion in a tip which are shown in Table 1.

As shown in Tables 1 and 2 and FIG. 4, the spark wear resistance of the spark plugs including the tip included in the scope of the present invention of the present application was evaluated as favorable.

Test Nos. 41 to 47

A test was conducted and spark wear resistance was evaluated in the same manner as test Nos. 1 to 40, except that: the composition of the metal base material was that Ir was 68 mass %, Rh was 20 mass %, Ru was 11 mass %, and Ni was 1 mass %; the area proportion of the oxide particles in an observation region by an FE-SEM was 5%; and tips were used in which the ratio (M/N) was changed by adjusting the powder particle size of oxide, a sintering temperature and a sintering time for a green compact of metal powder and oxide powder, and the like. The results are shown in Table 3 and FIG. 5.

TABLE 3

| | No. | Ratio (M/N) | Test results Wear volume proportion (%) $SrZrO_3$ | $BaHfO_3$ |
|---|---|---|---|---|
| Ex. | 41 | 0.05 | 52.6 | 52.6 |
| | 42 | 0.10 | 52.6 | |
| | 43 | 0.20 | 52.7 | |
| | 44 | 0.40 | 52.8 | 52.7 |
| | 45 | 0.60 | 52.9 | |
| | 46 | 0.85 | 53.2 | 53.2 |
| | 47 | 0.95 | 56.5 | 56.4 |

Figure 5:
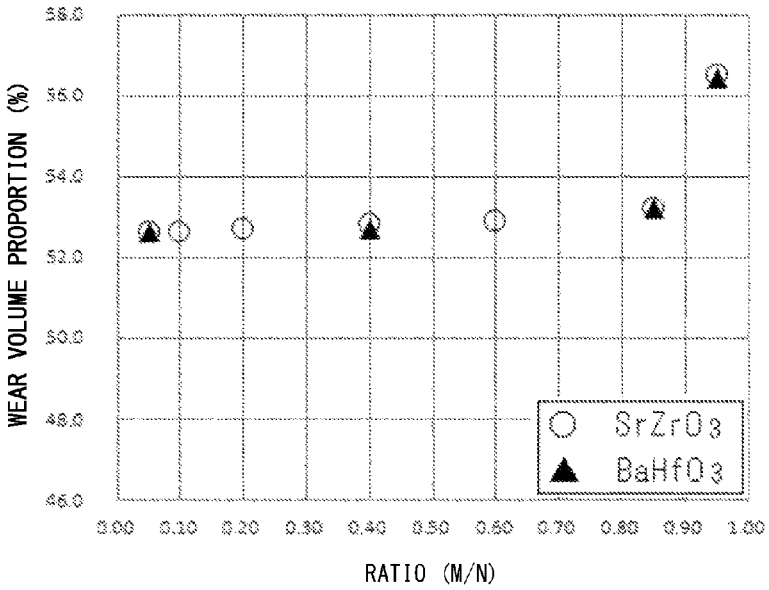
FIG. 5 Graph showing a relationship between a ratio (M/N) and a wear volume proportion in a tip which are shown in Table 3.

As shown in Table 3 and FIG. 5, when the number of the oxide particles present on the crystal grain boundary of the metal base material was within a predetermined range and the ratio (M/N) was equal to or lower than 0.85, the spark wear resistance was evaluated as even more favorable.

Test Nos. 48 to 54

A test was conducted and spark wear resistance was evaluated in the same manner as test Nos. 1 to 40, except that: the composition of the metal base material was that Ir was 68 mass %, Rh was 20 mass %, Ru was 11 mass %, and Ni was 1 mass %; the area proportion of the oxide particles in an observation region by an FE-SEM was 5%; and tips were used in which the size of the crystal grains of the metal base material was changed by adjusting the powder particle size of oxide, a sintering temperature and a sintering time for a green compact of metal powder and oxide powder, and the like. The results are shown in Table 4 and FIG. 6.

TABLE 4

| | No. | Average grain size of crystal grains of metal base material (μm) | Test results Wear volume proportion (%) $SrZrO_3$ | $BaHfO_3$ |
|---|---|---|---|---|
| Ex. | 48 | 1 | 56.0 | |
| | 49 | 3 | 52.9 | 52.8 |
| | 50 | 5 | 52.8 | |
| | 51 | 30 | 52.6 | 52.5 |
| | 52 | 80 | 52.5 | |
| | 53 | 150 | 52.3 | 52.2 |
| | 54 | 160 | 52.2 | |

Figure 6:
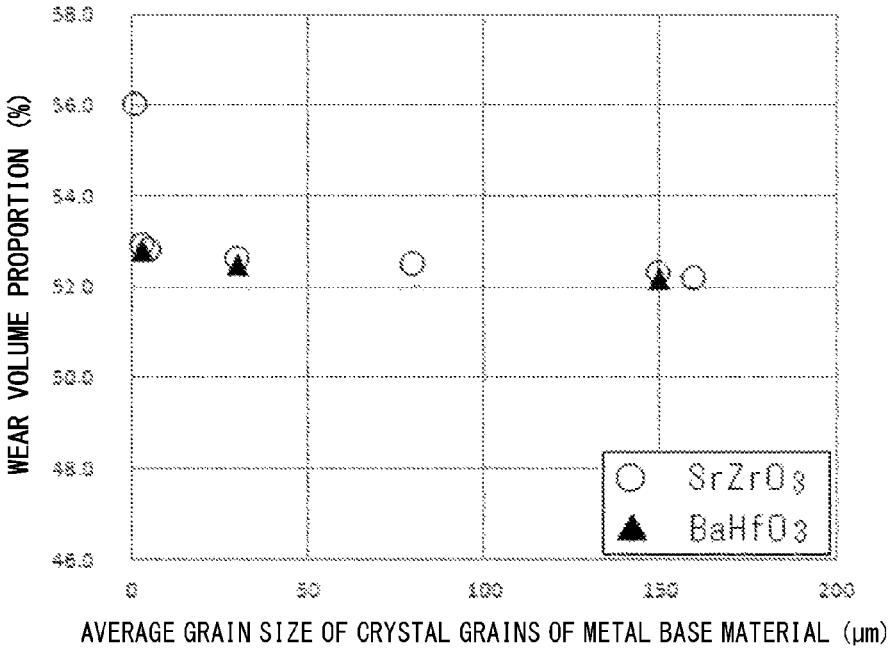
FIG. 6 Graph showing a relationship between an average grain size of crystal grains of a metal base material and a wear volume proportion in a tip which are shown in Table 4.

As shown in Table 4 and FIG. 6, when the average grain size of the crystal grains of the metal base material was in the range of 3 to 150 μm, the spark wear resistance was evaluated as even more favorable. When the average grain size of the crystal grains of the metal base material was 160 μm, falling off of the crystal grains of the metal base material from the tip occurred.

Test Nos. 55 to 63

A test was conducted and spark wear resistance was evaluated in the same manner as test Nos. 1 to 40, except that: the composition of the metal base material was that Ir was 68 mass %, Rh was 20 mass %, Ru was 11 mass %, and Ni was 1 mass %; the area proportion of the oxide particles in an observation region by an FE-SEM was 5%; and tips were used in which the size of the oxide particles was changed by adjusting the powder particle size of oxide, a sintering temperature and a sintering time for a green compact of metal powder and oxide powder, and the like. The results are shown in Table 5 and FIG. 7.

TABLE 5

| | No. | Average particle size of oxide particles (μm) | Test results Wear volume proportion (%) $SrZrO_3$ | $BaHfO_3$ |
|---|---|---|---|---|
| Ex. | 55 | 0.04 | 55.5 | |
| | 56 | 0.05 | 53.5 | 53.4 |
| | 57 | 0.1 | 52.5 | 52.4 |
| | 58 | 1 | 52.4 | 52.3 |
| | 59 | 5 | 52.2 | |
| | 60 | 7 | 52.0 | |
| | 61 | 15 | 52.1 | 52.5 |
| | 62 | 30 | 52.4 | |
| | 63 | 35 | 55.1 | |

Figure 7:
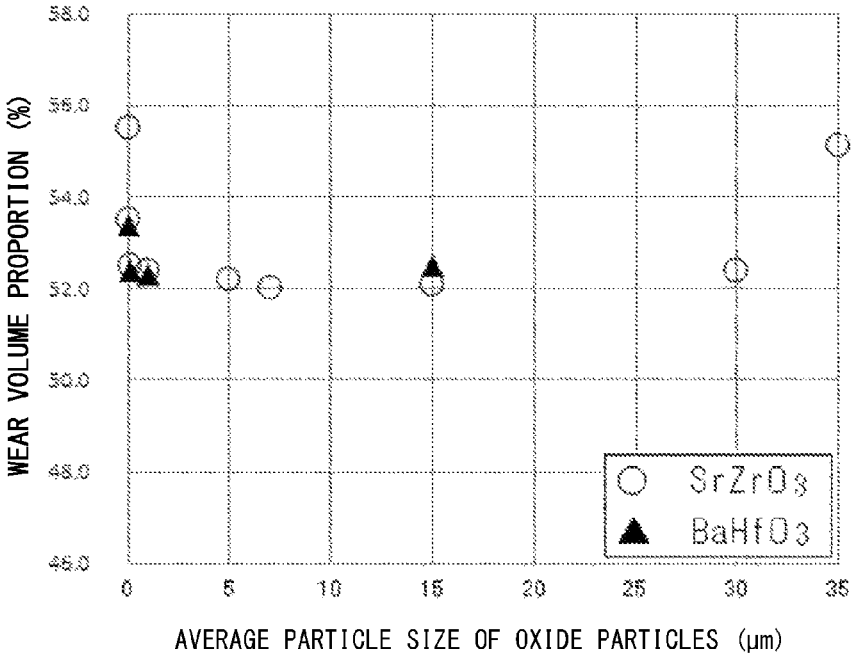
FIG. 7 Graph showing a relationship between an average particle size of the oxide particles and a wear volume proportion in a tip which are shown in Table 5.

As shown in Table 5 and FIG. 7, when the average particle size of the oxide particles was in the range of 0.05 to 30 μm, the spark wear resistance was evaluated as even more favorable.

Test Nos. 64 to 69

A test was conducted and spark wear resistance was evaluated in the same manner as test Nos. 1 to 40, except that: the composition of the metal base material was that Ir was 68 mass %, Rh was 20 mass %, Ru was 11 mass %, and Ni was 1 mass %; the area proportion of the oxide particles in an observation region by an FE-SEM was 5%; and tips were used in which the length of the diameter of each cylindrical tip was changed. The results are shown in Table 6 and FIG. 8.

TABLE 6

| | No. | Firing end specifications Tip diameter (mm) | Discharge area ($mm^2$) | Test results Wear volume proportion (%) $SrZrO_3$ | $BaHfO_3$ |
|---|---|---|---|---|---|
| Ex. | 64 | 0.4 | 0.13 | 48 | 48.2 |
| | 65 | 0.8 | 0.50 | 52 | |
| | 66 | 1 | 0.79 | 53 | 52.9 |
| | 67 | 1.5 | 1.77 | 53 | |
| | 68 | 2 | 3.14 | 54 | |
| | 69 | 3 | 7.07 | 54 | 54.0 |

Figure 8:
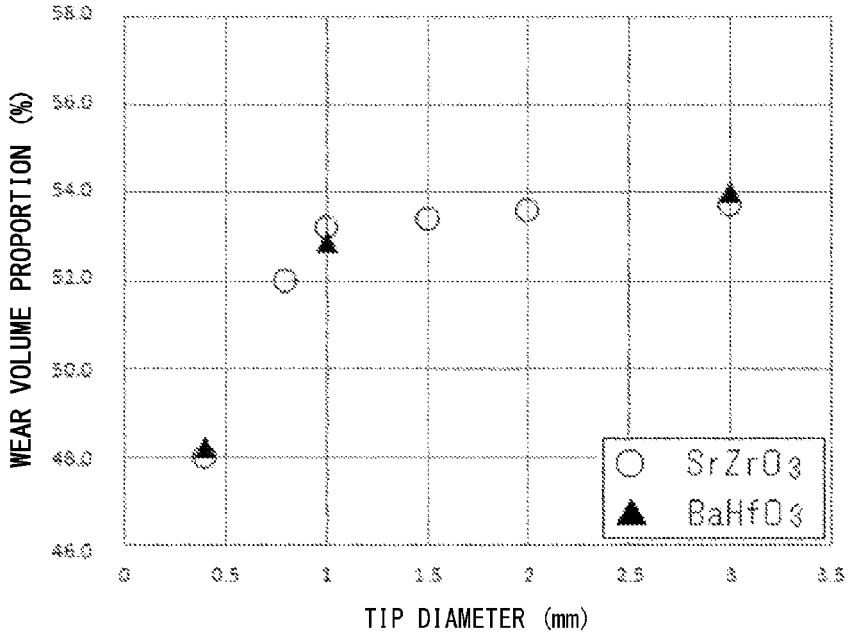
FIG. 8 Graph showing a relationship between a tip diameter and a wear volume proportion in a tip which are shown in Table 6.

As shown in Table 6 and FIG. 8, when the diameter of the tip was smaller than 1 mm, the spark wear resistance was evaluated as even more favorable.

Test Nos. 70 to 75

A test was conducted and spark wear resistance was evaluated in the same manner as test Nos. 1 to 40, except that: the composition of the metal base material was that Ir was 68 mass %, Rh was 20 mass %, Ru was 11 mass %, and Ni was 1 mass %; the area proportion of the oxide particles in an observation region by an FE-SEM was 5%; and spark plugs were used in which the degree of welding the tip to the ground electrode was changed. The results are shown in Table 7 and FIG. 9.

TABLE 7

| | No. | F/L | Fusion portion specifications Tip diameter L (mm) | Fusion portion length F (mm) | Test results Wear volume proportion (%) $SrZrO_3$ | $BaHfO_3$ |
|---|---|---|---|---|---|---|
| Ex. | 70 | 0.1 | 0.75 | 0.075 | 53.2 | 53.1 |
| | 71 | 0.3 | 0.75 | 0.225 | 53.1 | |
| | 72 | 0.6 | 0.75 | 0.45 | 53.0 | 52.9 |
| | 73 | 0.7 | 0.75 | 0.525 | 52.0 | |
| | 74 | 0.8 | 0.75 | 0.6 | 51.0 | |
| | 75 | 1 | 0.75 | 0.75 | 49.5 | 48.9 |

Figure 9:
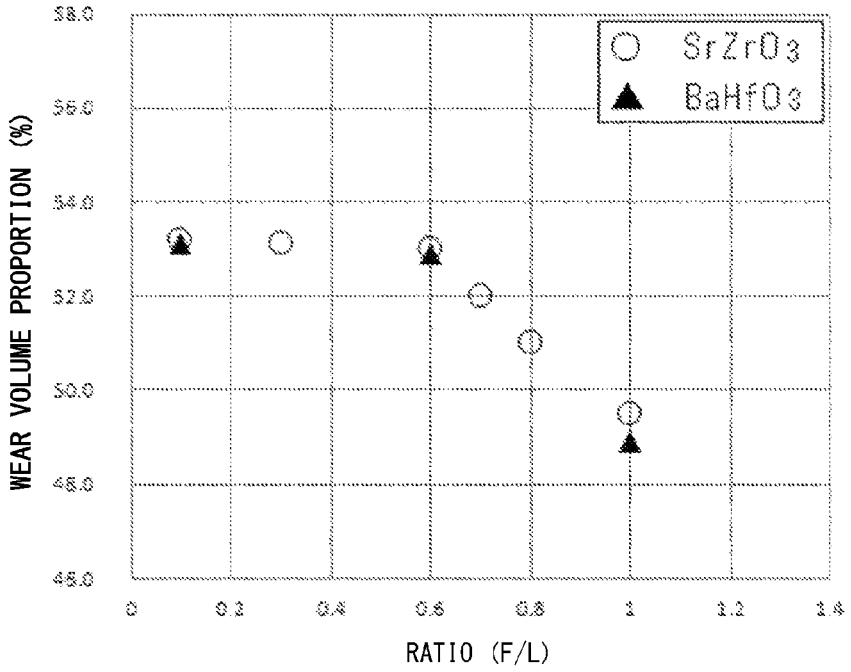
FIG. 9 Graph showing a relationship between a ratio (F/L) and a wear volume proportion in a tip which are shown in Table 7.

As shown in Table 7 and FIG. 9, when the ratio (F/L) was equal to or higher than 0.6, the spark wear resistance was evaluated as even more favorable.

DESCRIPTION OF REFERENCE NUMERALS

1: spark plug
2: axial bore
3: insulator
4: center electrode
5: metal terminal
6: metallic shell
7: ground electrode
8, 9: tip
10, 11: seal body
12: resistor
13: flange portion
14: rear trunk portion
15: front trunk portion
16: leg portion
17: screw portion
18: gas seal portion
19: gasket
20: tool engagement portion
21: crimping portion
22, 23: packing
24: talc
25: exposure portion
26: columnar portion
27: outer layer
28: core portion
31: crystal grain of metal base material
32: oxide particle
33: fusion portion
G: spark discharge gap

What is claimed is:

1. A spark plug comprising a center electrode and a ground electrode disposed with a gap provided between the center electrode and the ground electrode, wherein at least one of the center electrode and the ground electrode includes a tip which defines the gap, the tip includes a metal base material containing Ir as a main component, and oxide particles containing at least one of oxides having a perovskite structure represented by general formula ABO3, where A is at least one element selected from elements in group 2 in a periodic table, and B is at least one element selected from metal elements, and when a cross section of the tip is observed, an area proportion of the oxide particles is not lower than 1% and not higher than 13%.

2. A spark plug according to claim 1, wherein the metal base material contains Rh, and a ratio (M/N) of a number M of the oxide particles present on a crystal grain boundary of the metal base material relative to a total number N of the oxide particles contained in the tip is equal to or lower than 0.85.

3. A spark plug according to claim 1, wherein crystal grains of the metal base material have an average grain size of 3 to 150 μm.

4. A spark plug according to claim 1, wherein the oxide particles have an average particle size of 0.05 to 30 μm.

5. A spark plug according to claim 1, wherein the metal base material contains not less than 1 mass % and not greater than 35 mass % of Rh.

6. A spark plug according to claim 5, wherein the metal base material contains not less than 5 mass % and not greater than 20 mass % of Ru.

7. A spark plug according to claim 1, wherein the metal base material contains not less than 0.4 mass % and not greater than 3 mass % of Ni.

8. A spark plug according to claim 1, wherein the oxide is at least one of SrZrO3, SrHfO3, BaZrO3, and BaHfO3.

9. A spark plug according to claim 1, wherein the tip has a cylindrical shape and has a diameter R of at most 1 mm.

10. A spark plug according to claim 1, wherein in a cut surface of the tip that has been cut along a plane passing through an axis of the tip, a ratio (F/L) between a length F, of a fusion portion formed by fusion of the tip and the center electrode and/or the ground electrode, on a straight line indicating a joint surface between the tip and the center electrode and/or the ground electrode in a range from one side surface of the tip to another side surface of the tip and a length L of the tip in a direction perpendicular to the axis is equal to or higher than 0.6.

* * * * *